US005904048A

United States Patent [19]

Lee

[11] Patent Number: 5,904,048

[45] Date of Patent: May 18, 1999

[54] METHOD AND APPARATUS FOR USING D.C. POWER TO OPEN AND CLOSE AN AIR OUTLET OF AN AIR CONDITIONER

[75] Inventor: Gab-Youl Lee, Suwon, Rep. of Korea

[73] Assignee: Samsung Electronics Co., Ltd., Suwon, Rep. of Korea

[21] Appl. No.: 08/751,431

[22] Filed: Nov. 20, 1996

[30] Foreign Application Priority Data

Nov. 25, 1995 [KR] Rep. of Korea ..... 95-43766

[51] Int. Cl.[6] ..... F25B 49/00

[52] U.S. Cl. ..... 62/131; 62/180; 454/236; 454/324

[58] Field of Search ..... 62/131, 180, 186, 62/89, 408, 409, 262; 340/524, 686; 318/264, 265, 266, 267, 282, 286, 468; 454/236, 239, 296, 324; 236/49.3

[56] References Cited

U.S. PATENT DOCUMENTS

| | | | |
|---|---|---|---|
| 4,533,905 | 8/1985 | Leivenzon et al. | 340/524 |
| 4,882,913 | 11/1989 | LaCount, II et al. | 62/409 |
| 5,369,913 | 12/1994 | Brickner | 318/760 X |
| 5,461,875 | 10/1995 | Lee et al. | 62/180 X |

*Primary Examiner*—Harry B. Tanner
*Attorney, Agent, or Firm*—Burns, Doane, Swecker & Mathis, L.L.P.

[57] ABSTRACT

An air outlet of an air conditioner is opened and closed by a door. A D.C. motor is operably connected to the door for opening and closing the door. The D.C. motor is supplied with D.C. power in response to the operation or stopping of the air conditioner.

2 Claims, 8 Drawing Sheets

METHOD AND APPARATUS FOR USING D.C. POWER TO OPEN AND CLOSE AN AIR OUTLET OF AN AIR CONDITIONER

BACKGROUND OF THE INVENTION

1. Field of the Invention

The present invention relates to a method and apparatus to actuate a door for opening/closing a discharging outlet of an air conditioner.

2. Description of the Prior Art

In general, for the purpose of preventing dusts or foreign substances in the room from passing into the indoor unit of the conventional air conditioner during the standby state, the air conditioner is equipped with a discharging outlet door which enables a discharging outlet for discharge of air heat-exchanged by an evaporator to be closed. Namely, when a stop command signal is input during an operation of the air conditioner, or when the air conditioner is under the stand-by state after the operation of the air conditioner is completed, a relay employed for effecting the upward motion of the discharging outlet door under the control of a control unit is energized, thus allowing an AC door motor to be driven. Accordingly, an operation of the AC door motor moves the discharging outlet door in the upward direction to thereby close the discharging outlet.

Meanwhile, if an operation command signal is input during the stand-by state of the air conditioner, another relay employed for effecting a downward motion of the di s charging outlet door under the control of a control portion is energized, thus allowing the AC door motor to drive in a reverse direction. Accordingly, the AC door motor is operated to move the discharging outlet door in the downward direction to open the discharging outlet.

At this time, either an open ed state or a closed state of the discharging outlet is detected by means of photo-sensors, each being provided at a predetermined position around upper and lower portions of the discharging outlet, and the photo-sensor produces a door open/close signal. This signal is then applied to the control unit which determines whether the discharging outlet door is at the opened state or closed state, based upon the door open/close signal from the photo-sensor, while it also controls the normal operation or the standby state of the air conditioner.

However, there is a problem with the conventional apparatus employing the above described schemes, in that the AC door motor for moving up and down the discharging outlet door and relays for supplying the power to said AC door motor are expensive, and malfunction of the air-conditioner caused by moisture contained within the air conditioner having the AC door motor may occur.

SUMMARY OF THE INVENTION

Therefore, it is an object of the present invention to provide an apparatus for opening/closing a discharging outlet of an air conditioner and method thereof, wherein costs can be reduced with the movement of a discharging outlet door through use of a DC motor, and stability of the apparatus can be guaranteed through use of a DC power supply.

The above-mentioned objects can be accomplished by an apparatus for opening/closing a discharging outlet of an air conditioner comprising a suction inlet for sucking a room air, an indoor heat exchanger for heat-exchanging the sucked air, a discharging outlet for discharging the air heat-exchanged by the indoor heat exchanger, and a discharging outlet door for opening/closing the discharging outlet so as to prevent dust or foreign substances from passing through the discharging outlet, the apparatus for opening/closing the discharging outlet comprising:

operation manipulating means for inputting an operation/stop command signal for the air conditioner;

door motor driving means for driving a D.C. door motor to open/close the discharging outlet door based upon the operation/stop command signal; and control means for controlling a supply of the power for the door motor in accordance with the operation/stop command signal.

Furthermore, according to another aspect of the present invention, there is provided with a method for opening/closing a discharging outlet of an air conditioner, the method comprising the steps of:

(a) initializing the air conditioner;

(b) supplying D.C. power to a D.C. motor for opening the a discharging outlet for performing an operation of the air conditioner;

(c) performing an operation of the air conditioner based upon operation conditions established by a user, when completing the opening of the discharging outlet;

(d) stopping the air conditioner when a stop command signal is input during the operation of the air conditioner; and (e) supplying D.C. power to the D.C. motor for closing the discharging outlet and standing-by, with the stop of the air conditioner.

BRIEF DESCRIPTION OF THE DRAWINGS

Other objects and aspects of the invention will become apparent from the following description of embodiment with reference to the accompanying drawings in which.

Figure 7A:
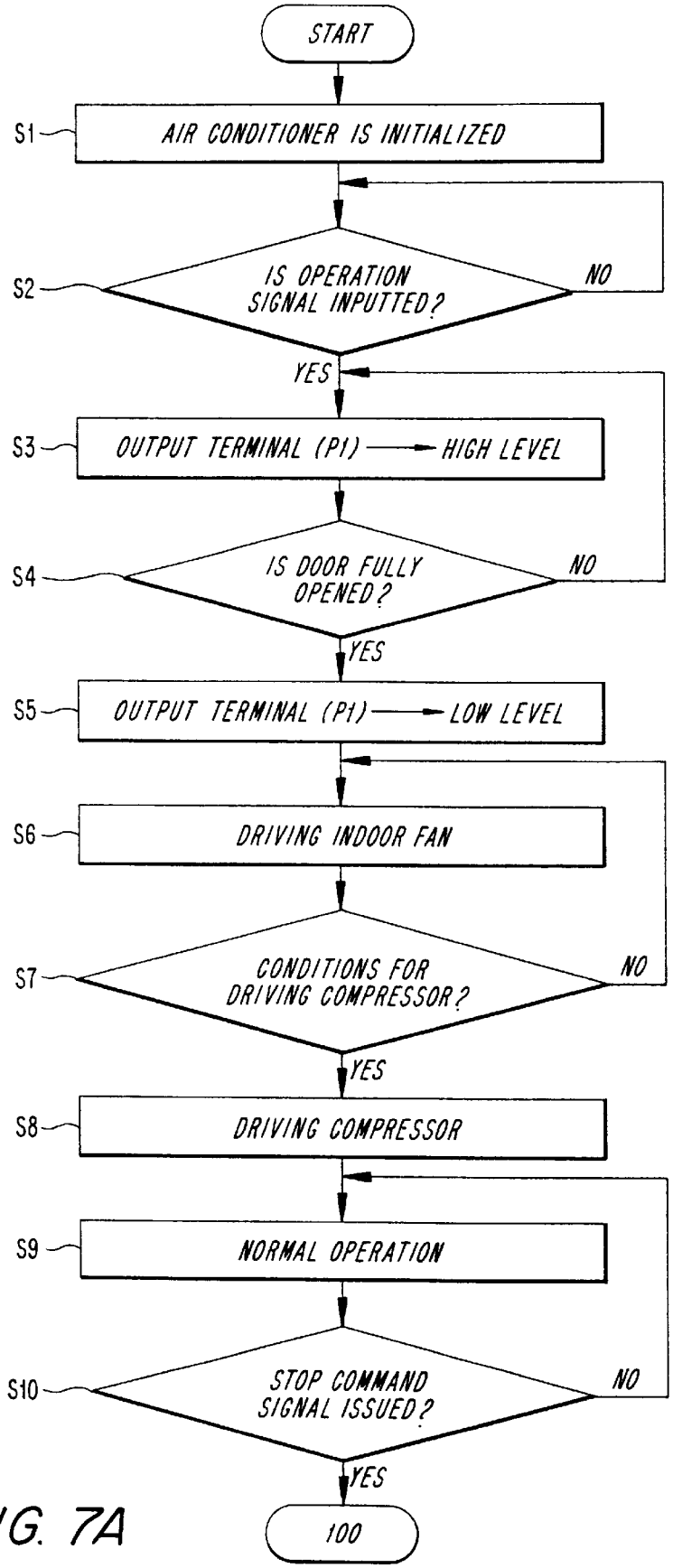
Figure 7B:
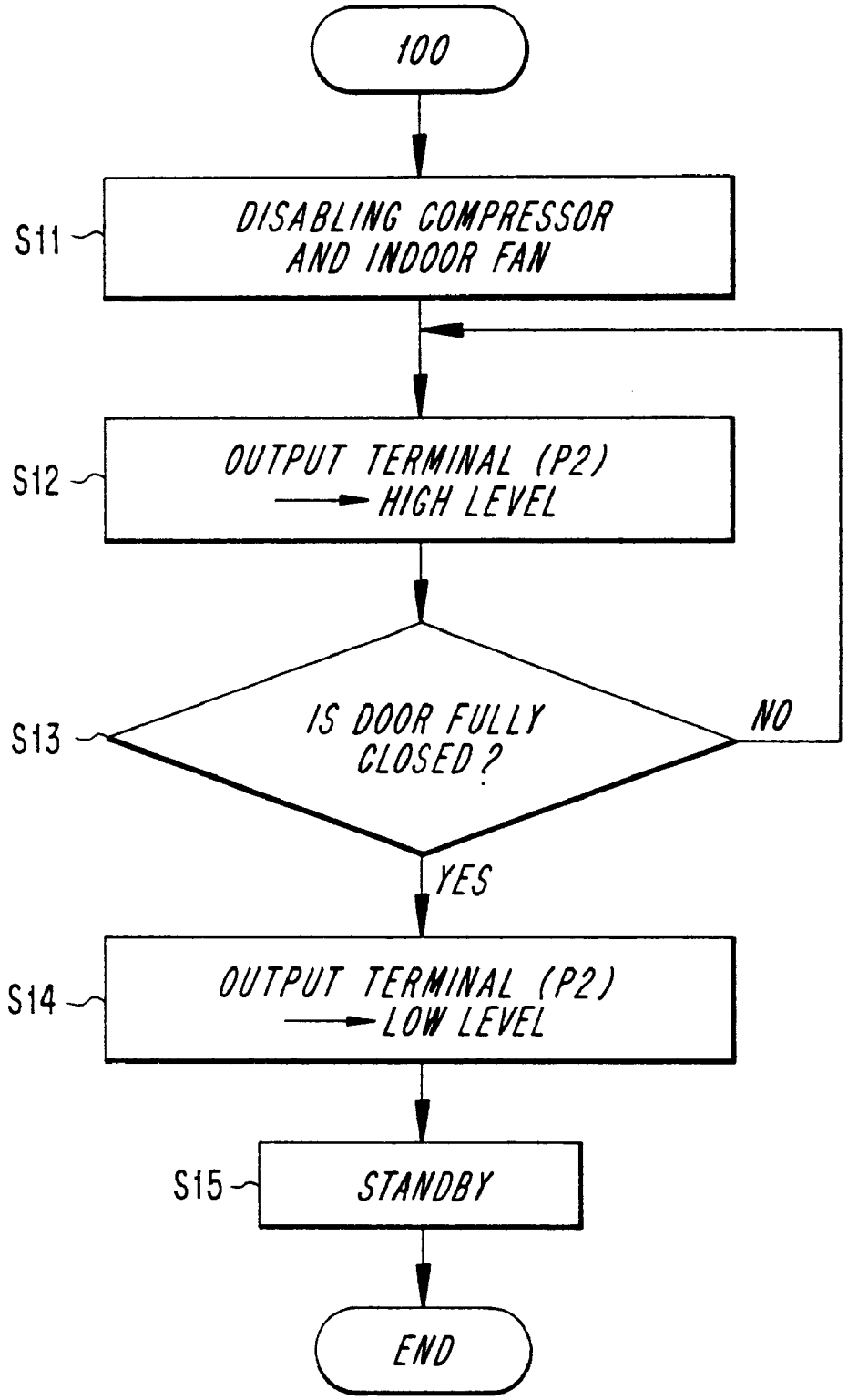

Both of FIGS. 7A and 7B are flow charts explaining the sequential procedures for controlling the opening/closing of the discharging outlet in accordance with the present invention.

DETAILED DESCRIPTION OF THE PREFERRED EMBODIMENT

The preferred embodiment according to the present invention will be described in detail with reference to the accompanying drawings.

Figure 1:
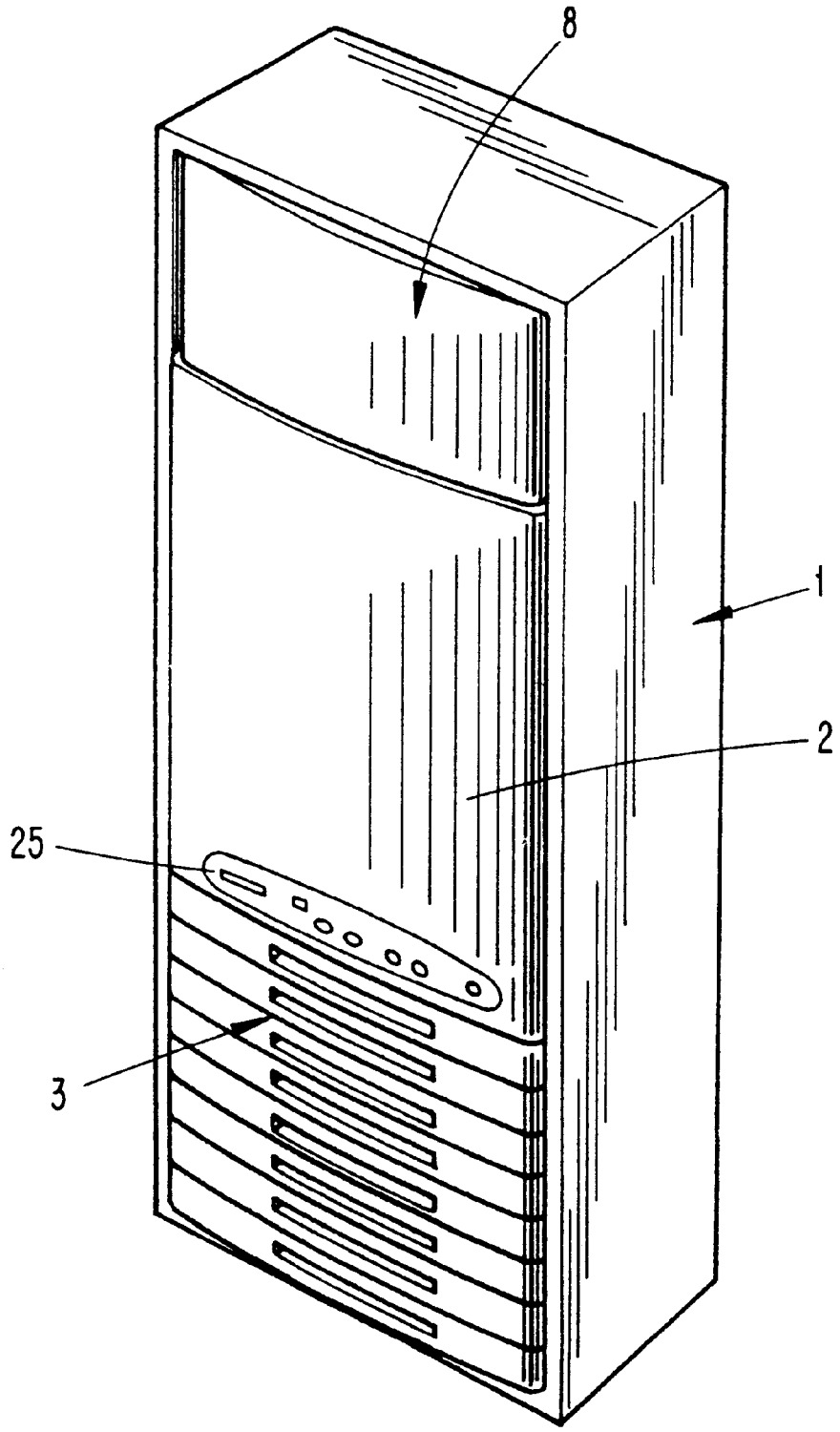
FIG. 1 is a perspective view of an air conditioner, with a discharging outlet closed in accordance with an embodiment of the present invention.
Figure 2:
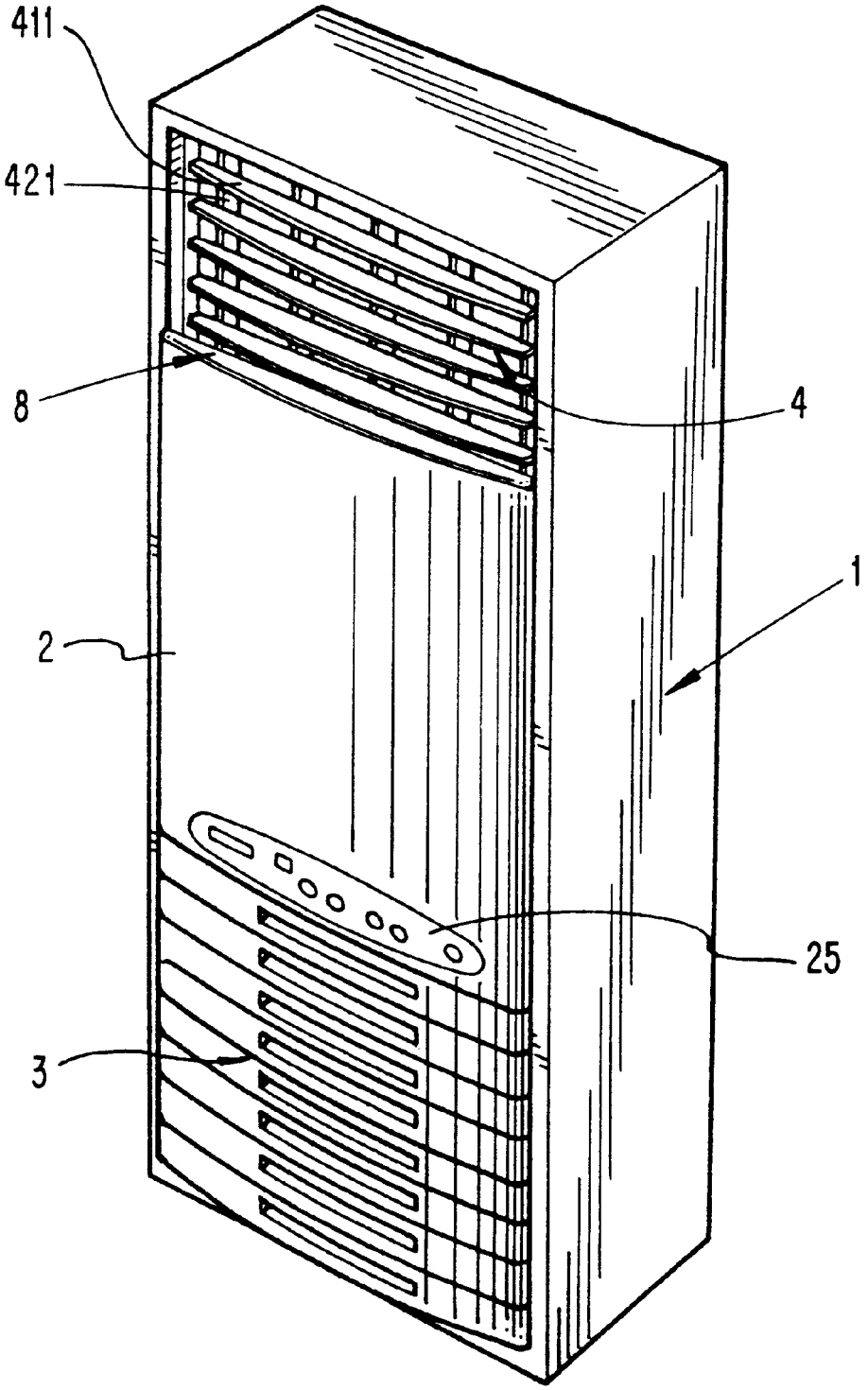
FIG. 2 is a perspective view of the air conditioner, with the discharging outlet opened.
Figure 3:
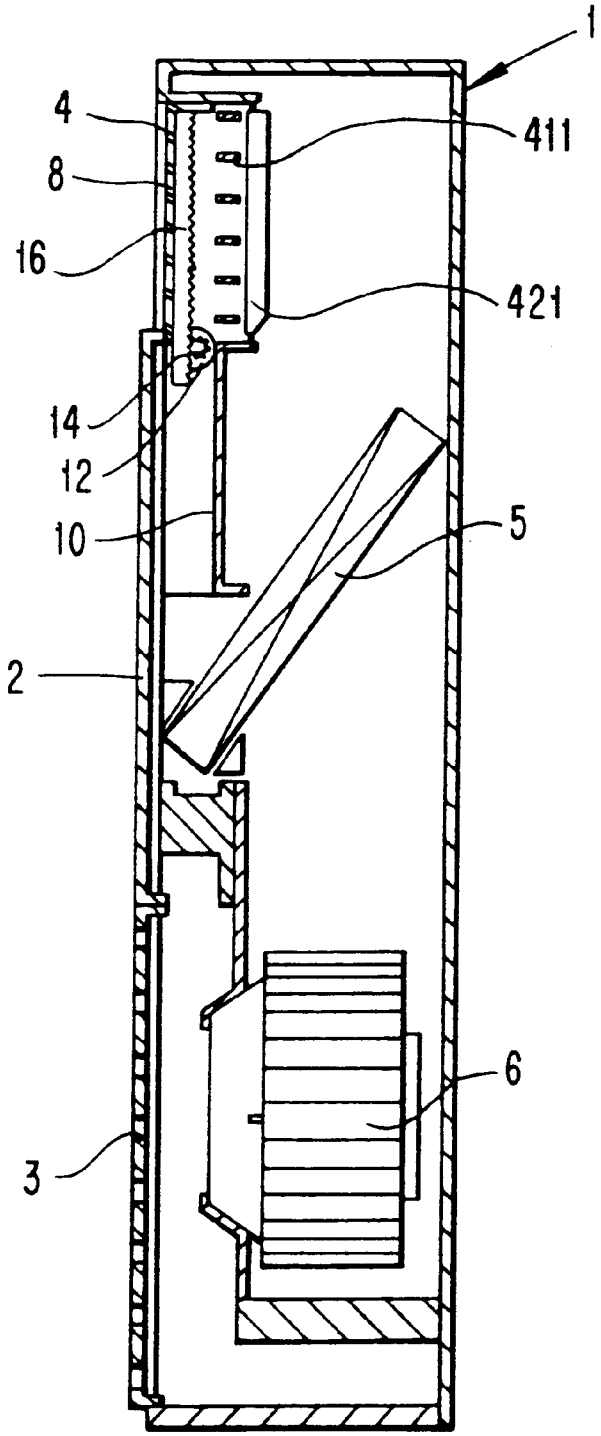
FIG. 3 is a schematic side sectional view of the air conditioner.

Referring to FIG. 1 to FIG. 3, reference numeral 1 denotes an indoor unit (hereinafter, simply referred to as a body) of an air conditioner, which has a front surface. On the front face is fixed a cover member 2 which has operation manipulating means 25 located at a predetermined position of the cover member 2.

The body 1 has a suction inlet 3 arranged to suck a room air at the bottom portion of the front face, and a discharging outlet 4 (See FIG. 2) for discharging indoors the heat-exchanged air(cold air or warm air) at the upper portion of the front face, wherein the discharging outlet 4 is provided with an up/down air flow directing louver 411 and a left/right air flow directing louver 421 for adjusting the direction of the discharged air.

As shown in FIG. 3, the body 1 is provided at an approximate central portion inside the body 1 with an oblong-shaped indoor heat exchanger 5 to heat-exchange the room air sucked through the suction inlet 3, utilizing the evaporation latent heat of the refrigerant, with the desired cold air or warm air. Below the heat exchanger 5 is disposed an indoor fan 6 for sucking the room air through the suction inlet 3 and also discharging indoors the heat-exchanged air through the discharging outlet 4.

Also, the discharging outlet 4 is provided with a door 8 which can be opened to facilitate supply of the air into the room when the air conditioner is operating, and be closed to prevent dust or foreign substances from passing through the discharging outlet 4 and into the main body during the standby state. This discharging outlet door 8 is also designed to give a good appearance.

Driving means adapted to effect an upward and downward motion of the discharging outlet door 8 includes a support member 10 fixed at an upper portion of the indoor unit 1, a DC door motor 12(hereinafter, simply referred to as a door motor) fixedly secured to the support member 10 and for supplying a dynamic force required to move upwardly and downwardly the discharging outlet door 8, a pinion gear 14 coupled to a shaft 12*a* of the door motor 12 and rotated by a dynamic power delivered through said shaft 12*a*, and a rack gear 16, which changes the rotary motion of the pinion gear 14 into linear motion, for effecting the upward motion or downward motion of the discharging outlet door 8 according to the direction of rotation of the pinion gear 14.

Figure 5:
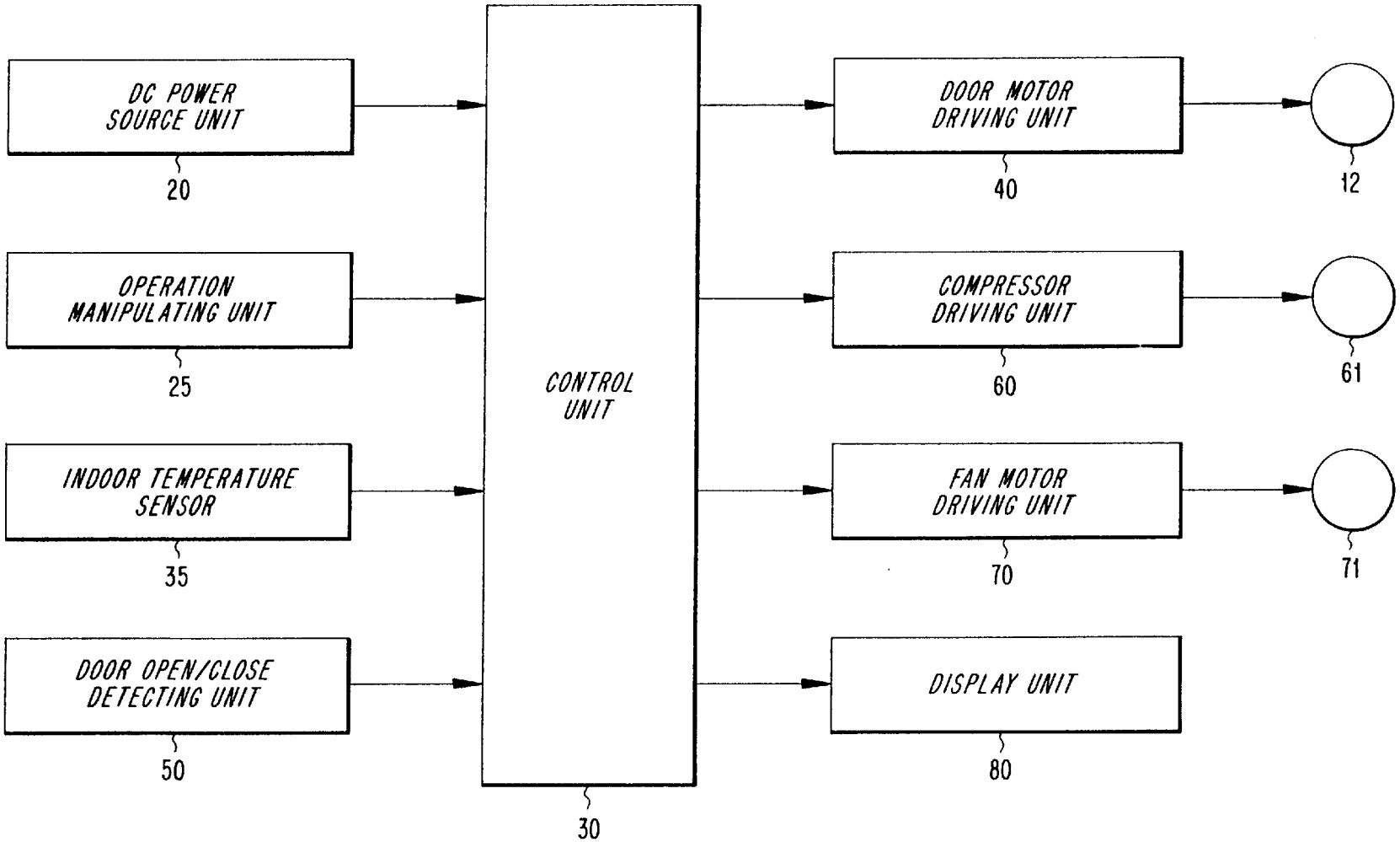
FIG. 5 is a block diagram of an apparatus for opening/closing the discharging outlet in accordance with the present invention.

FIG. 5 is a block diagram illustrating a circuit for controlling the opening/closing of the discharging outlet door of the air conditioner as described above, and FIG. 6 is a detailed circuit diagram of door motor driving means which is applied to the preferred embodiment of the present invention.

Figure 6:
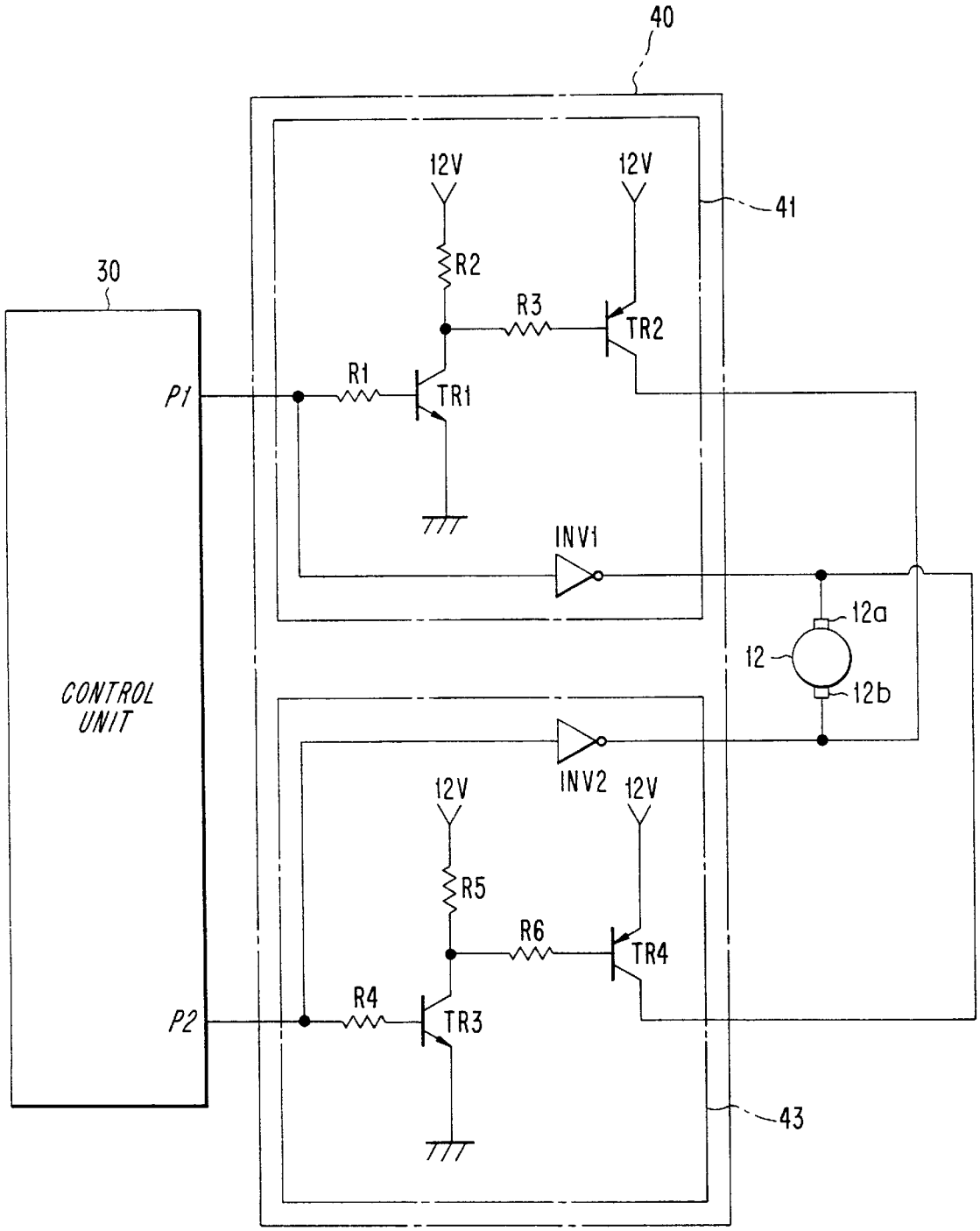
FIG. 6 is a detailed circuit diagram of a door motor driving means according to the present invention.

As shown in FIGS. 5 and 6, a commercial AC power supplied from an AC power source block(not shown) is converted into a DC voltage with a voltage level required to activate the air conditioner, which is applied to control means and each driving means as will be described below.

Operation manipulating mean s 25 comprises manual input keys for setting the desired operation conditions of the air conditioner(such as artificial intelligence operation, air-conditioning, air cleaning, operation booking, operation/stop, etc.), and a manual operation selecting key for inputting the operation/stop command signal for the air conditioner.

When a DC voltage from DC power source means 20 is applied to control means 30, the air conditioner is initialized by the control means 30 which is a microcomputer employed to control the general operation of the air conditioner, for controlling the supply/break of an electric power required to open/close the door 8 in accordance with the operation/stop command signals from the operation manipulating means 25.

During the proper operation of the air-conditioner, indoor temperature sensing means 35 detects the temperature Tr of the air sucked through the suction inlet 3 so as to constantly maintain the temperature Ts set by the user through the operation manipulating means 25.

Furthermore, door motor driving means 40 is provided to drive the door motor 12 to move up and down the door 8 for opening/closing the discharging outlet 4, in case the control means 30 receives the operation/stop command signals from the operation manipulating means 25 and then outputs the control signals to the door motor driving means 40. The door motor driving means 40 includes a door opening unit 41 (see FIG. 6) for driving the door motor 12 to open the door 8 according to a control signal output from the control means 30 by the operation command signal through the operation manipulating means 25, and a door closing unit 43 for driving the door motor 12 to close the door 8 according to the control signal output from the control means 30 by the operation stop command signal through the operation manipulating means 25.

Door open/close detecting means 50 serves to detect whether the discharging outlet 4 is opened or closed according to a position of the door 8 adapted to move up and down by the door motor driving means 40, and to supply the detected information to the control means 30.

Based upon the difference between a set temperature Ts established by the operation manipulating means 25, and an indoor temperature Tr measured by means of indoor temperature detecting means 35, the control means 30 outputs the control signal causing compressor driving means 60 to drive the compressor 61.

To discharge indoors the air heat-exchanged by the indoor heat exchanger 5, a fan motor driving means 70 receives the control signal from the control means 30 and adjusts the speed of an indoor fan motor 71 to drive an indoor fan 6. The control means 30 also controls display means 80 to display the operation conditions and temperature Ts set through the operation manipulating means 25 by the user, as well as the operating states of the air conditioner.

As shown in FIG. 6, the door opening unit 41 of the door motor driving means 40 includes an inverter INV1 for inverting the control signal at the output terminal P1 of the control means 30, a first transistor TR1 for receiving the control signal output from the output terminal P1 of the control means 30 via a first current limiting resistor R1 and thereby being turned on or off, a second transistor TR2 for receiving an output signal of the transistor TR1 via a second current limiting resistor R3 and thereby being turned on or off, and a load resistor R2 connected to a collector of the transistor TR1.

The door closing unit 43 of the door motor driving means 40, as shown in FIG. 6, includes an inverter INV2 for inverting the control signal at an output terminal P2 of the control means 30, a first transistor TR3 for receiving the control signal output from the output terminal P2 of the control means 30 via a first current limiting resistor R4 and thereby being turned on or off, a second transistor TR4 for receiving an output signal of the transistor TR3 via a second current limiting resistor R6 and thereby being turned on or off, and a load resistor R5 connected to a collector of the transistor TR3.

Both the inverter INV1 of the door opening unit 41 and the inverter INV2 of the door closing unit 43 may be included together in a single chip. The inverters function to output a low level signal when a high level signal is received thereto, and vice versa.

Now, the operation and advantages of the invention will be described. FIGS. 7A and 7B are flow charts illustrating sequential control procedures for opening/closing of the discharging outlet of the air conditioner.

It is assumed that the discharging outlet 4 remains closed as an initial condition for the purpose of the explanation.

First, when a power is applied to the air conditioner, a commercial AC power supplied from an AC power source block(not shown) is converted into a DC voltage with a voltage level required to activate the air-conditioner, which is applied to control means and each driving circuit.

Thus, at step S1, the air conditioner is initialized where a DC voltage from DC power source means 20 is applied to the air conditioner.

The user may set desired operation conditions such as cooling, heating, defrost, air-cleaning, and temperature Ts, etc through the operation manipulating means 25, and thereafter depress a manual operation switch, whereby the operation conditions and operation command signals (hereinafter, referred to as the operation signal) from the operation manipulating means 25 are input to the control means 30.

At step S2, the control means 30 determines whether or not an operation signal is input from the operation manipulating means 25. In case the operation signal is not yet input (in case of No), the air conditioner maintains the standby state with step S2 being repeated.

If the operation signal is input(in case of Yes), process advances to step S3 in which the control means 30 serves to output the control signal of a high level to the door motor driving means 40 through the output terminal P1 to open the discharging outlet 4 which is presently at the closed position.

The high level control signal output from the control means 30 through the output terminal P1 is applied to a base of the transistor TR1 through the current limiting resistor R1, thereby turning on the transistor TR1.

At this time, a signal of a low level is applied to the base of the transistor TR2, thereby turning on the transistor TR1. Subsequently the transistor TR2 is also turned on, with a result of that it allows the external voltage of 12V to be supplied to a winding 12*b* of the door motor 12.

Figure 4C:
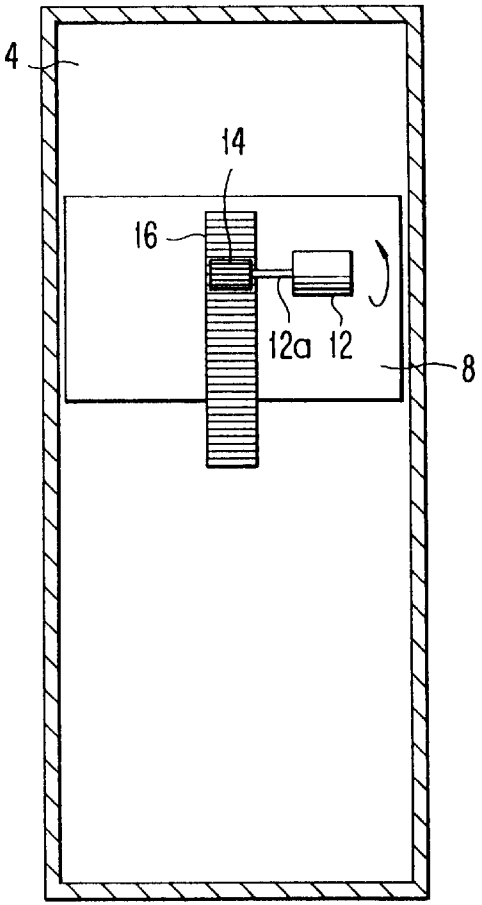
FIGS. 4A–4C illustrates the procedures for closing/opening the discharging outlet in accordance with the present invention.
Figure 4B:
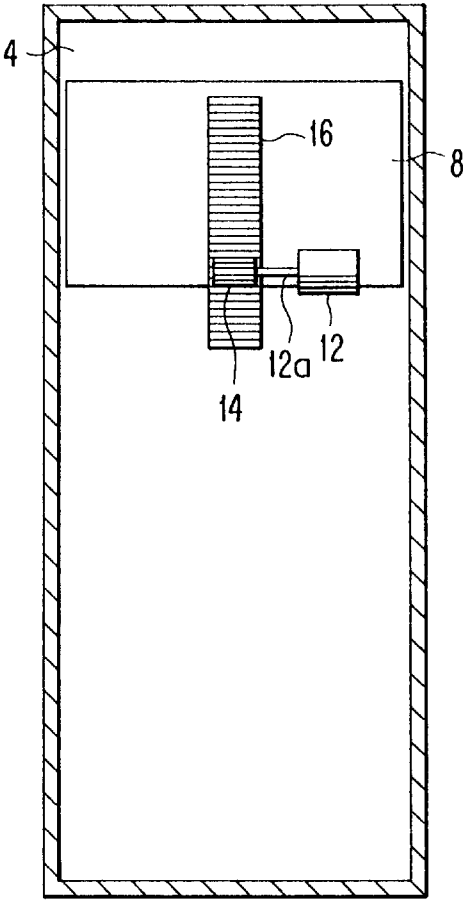
Figure 4A:
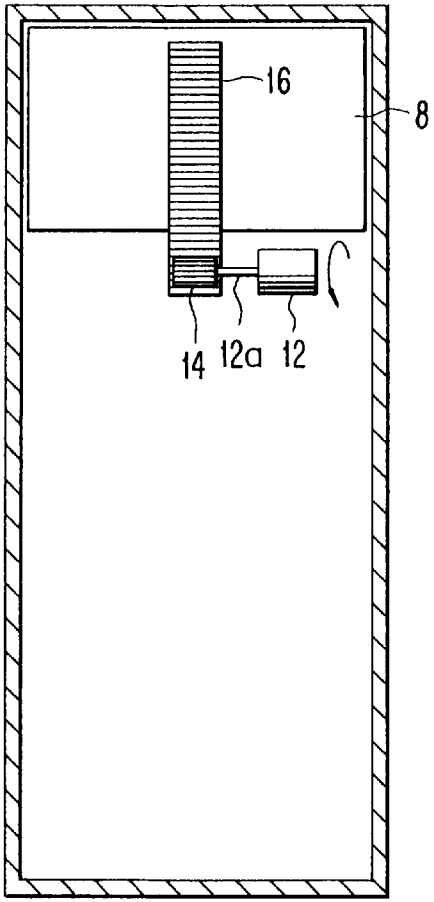

The control signal of a high level available from the output terminal P1 of the control means 30 is inverted to a low level by the inverter INV1, which is supplied to a winding 12*a* of the door motor 12 which in turn is driven in forward direction as shown FIGS. 4A through 4C.

Therefore, a rack gear 16 engaged with a pinion gear 14 which is coupled to a shaft 12*a* of the door motor 12 is moved in downward direction due to a rotation of the pinion gear 14. This causes the discharging outlet door 8 to move downward, resulting in the opening of the discharging outlet 4 as shown in FIG. 4(C).

Next, at step S4, the door open/close detecting means 50 detects a present position of the discharging outlet door 8 moved downward by the door motor 12, and the control means 30 receives a signal detected by the door open/close detecting means 50 and determines whether the discharging outlet 4 is fully opened or not.

As a result of the determination at step S4, if the discharging outlet 4 is not fully opened(in case of No), process returns to step S3, in which it continues to drive the door motor 12 until the discharging outlet door 8 is fully opened.

In case the discharging outlet 4 is fully opened(in case of Yes), process advances to step S5 in which the control means 30 outputs the control signal of low level through an output terminal P1 so as to finish the opening operation.

Accordingly, the control signal of the low level which is output through the output terminal P1 of the control means 30 is applied to the base of the transistor TR1 via the current limiting resistor R1 to turn off the transistor TR1.

With the transistor TR1 turned off, the signal of the high level is applied to the base of the transistor TR2, and then the transistor TR2 is turned off, thus causing a voltage applied to the winding 12*b* of the door motor 12 to be shut off.

And, the inverter INV1 which receives the control signal of the low level from the control mean 30 is operated to stop the driving of the door motor 12, thus the opening of the discharging outlet door 8 is finished.

Next, at step S6, the fan motor driving means 70 controls the speed of the indoor fan motor 71 under the control of the control means 40 to drive the indoor fan 6.

The indoor fan 6 is operated to begin to suck the indoor air through the suction inlet 3 and into the body 1, and the temperature Tr of the sucked air is detected by means of an air temperature detecting means 35.

At step S7, a comparison is made between the indoor temperature Tr detected by the indoor temperature detecting means 35 and the temperature Ts set by the user through the operation manipulating means 25, and then it is determined if the result meets one of the conditions for driving the compressor 61, in one of two modes, i.e., a first mode corresponding to cooling in which the compressor 61 is to be operated when the indoor temperature Tr detected by the indoor temperature sensing means 35 is higher than the set temperature Ts, and a second mode corresponding to heating in which the compressor 61 is to be operated when the indoor temperature Tr detected by the indoor temperature sensing means 35 is lower than the set temperature Ts.

If the comparison result at step S7 does not correspond to the condition for driving the compressor 61(in case of No), process returns to step S6 to continue to detect the indoor temperature Tr and repeat steps. If the comparison result at step S7 corresponds to the condition for driving the compressor 61 (in case of YES), process advances to step S8 in which an operation frequency for the compressor 61 is determined depending upon a difference between the temperatures Tr and Ts, and the control signal for driving the compressor 61 is provided to the compressor driving means 60.

The compressor driving means 60 is driven based upon the operation frequency determined by the control means 30, and then, at step S9, the air conditioner can perform its normal operation that discharges indoors the air heat-exchanged by the indoor heat exchanger 5 in compliance with operation conditions set by the user through the operation manipulating means 25.

Then, at step S10, under the normal operation of the air-conditioning, it is determined whether or not the operation stop command signal is issued from the operation manipulation means 25 and transmitted to the control means 30. If not(in case of NO), process returns to step S9 and the normal operation continues.

As a result of the determination at step S10, if the operation stop command signal is issued(in case of YES) during the normal operation, process advances to step S11 (see FIG. 7B), in which the control means 30 outputs the control signal to the compressor driving means 60 and the fan motor driving means 70 to disable the compressor 61 and the indoor fan motor 71, respectively.

Under the control of the control means 30, the compressor driving means 60 serves to stop the compressor 61, and the fan motor driving means 70 serves to stop the indoor fan motor 71, which causes the indoor fan 6 to stop its operation.

Next, process advances to step S12 in which the control signal of the high level at the output terminal P2 of the control means 30 is supplied to the door motor driving means 40 to close the discharging outlet 4 which is presently at the opened position.

Therefore, the control signal which is output from the output terminal P2 of the control means 30 is applied to a base of the transistor TR3 via the current limiting resistor R4 to turn off the transistor TR3.

With the transistor TR3 turned on, the signal of the low level is applied to a base of the transistor TR4, and then the transistor TR4 is turned off, thus causing an external voltage of 12V to be supplied to the winding 12*a* of the door motor 12.

The control signal of the high level through the output terminal P2 of the control means 30 is inverted by the inverter INV2 and supplied to the winding 12*b* of the door motor 12, so that the door motor 12 is rotated in reverse direction as shown in FIGS. 4A to 4C.

Therefore, the rack gear 16 engaged with the pinion gear 14 which is coupled to the shaft 12*a* of the door motor 12 is moved upwardly according to the rotation of the pinion gear 14. This causes the discharging outlet door 8 to move in upward direction, resulting in the closing of the discharging outlet 4.

Then, at step S13, the door open/close detecting means 50 detects the position of the discharging outlet door 8 moved upwardly by the door motor 12, and the control means 30 receives the signal detected by the door open/close detecting means 50 and determines whether or not the discharging outlet 4 is fully closed.

As a result of the determination at step S13, if the discharging outlet 4 is not fully closed(in case of No), process returns to step S12, in which it continues to drive the door motor 12 until the discharging outlet door 8 is fully closed. In case the discharging outlet 4 is fully closed(in case of Yes), process advances to step S14 in which the control means 30 outputs a control signal of the low level through the output terminal P2 so as to finish the closing of the discharging outlet door 8.

Accordingly, the control signal of the low level which is output through the output terminal P2 of the control means 30 is applied to the base of the transistor TR3 via the current limiting resistor R4, to thereby turn off the transistor TR3.

With the transistor TR3 turned off, the signal of the high level is applied to the base of the transistor TR4, and then the transistor TR4 is turned off, thus causing a voltage applied to the winding 12*a* of the door motor to be shut off.

And, the inverter INV2 which receives the control signal of the low level from the control mean 30 is operated to stop the driving of the door motor 12, thus the closing of the discharging outlet door 8 can be completed.

At step S15, the control means 30 remains at the stand-by state until the operation signal from the operation manipulating means 25 is again issued.

As described above, the discharging outlet open/close apparatus for the air conditioner and method according to the present invention has merit in that the costs can be lowered due to the driving of the discharging outlet door through of use of a DC motor, and stability of the apparatus can be guaranteed through use of DC power supply.

What is claimed is:

1. An air conditioner comprising:

a suction inlet for sucking-in a room air;

an indoor heat exchanger for heat-exchanging the sucked air;

a discharging outlet for discharging the air heat-exchanged by the indoor heat exchanger;

a discharging outlet door for opening/closing the discharging outlet so as to prevent dust and foreign substances from passing through the discharging outlet; and an apparatus for opening/closing the discharging outlet comprising:

operation manipulating means for inputting an operation/stop command signal;

a D.C. motor operably connected to the door for opening and closing the discharging outlet;

motor driving means connected to the door motor for driving the door motor to open/close the discharging outlet; and control means operably connected to the operation manipulating means and the motor driving means for controlling a supply of D.C. power to the door motor in response to the operation/stop command signal;

wherein the door motor driving means comprises:

a door opening unit for receiving a control signal from the control means when an operation command signal is input through the operation manipulating means, and driving the door motor to open the discharging outlet door, the door opening unit comprising:

an inverter for inverting the control signal from the control means;

a first transistor to receive the control signal output from the control means via a first current limiting resistor, thereby to be turned on or off;

a second transistor to receive an output signal of the first transistor via a second current limiting resistor, thereby to be turned on or off; and a load resistor connected to collector of the first transistor; and a door closing unit for receiving the control signal from the control means when a stop command signal is input through the operation manipulating means, and driving the door motor to close the discharging outlet door.

2. An air conditioner comprising:

a suction inlet for sucking-in a room air;

an indoor heat exchanger for heat-exchanging the sucked air;

a discharging outlet for discharging the air heat-exchanged by the indoor heat exchanger;

a discharging outlet door for opening/closing the discharging outlet so as to prevent dust and foreign substances from passing through the discharging outlet; and an apparatus for opening/closing the discharging outlet comprising:

operation manipulating means for inputting an operation/stop command signal;

a D.C. motor operably connected to the door for opening and closing the discharging outlet;

motor driving means connected to the door motor for driving the door motor to open/close the discharging outlet; and control means operably connected to the operation manipulating means and the motor driving means for controlling a supply of D.C. power to the door motor in response to the operation/stop command signal;

wherein the door motor driving means comprises:

a door opening unit for receiving a control signal from the control means when an operation command signal is input through the operation manipulating means, and driving the door motor to open the discharging outlet door; and a door closing unit for receiving the control signal from the control means when a stop command signal is input through the operation manipulating means, and driving the door motor to close the discharging outlet door, wherein the door closing unit comprises:

an inverter for inverting the control signal from the control means;

a first transistor to receive the control signal output from the control means via a first current limiting resistor, thereby to be turned on or off;

a second transistor to receive an output signal of the first transistor via a second current limiting resistor, thereby to be turned on or off; and a load resistor connected to collector of the first transistor.

* * * * *